US008563099B2

(12) United States Patent
Gilardi

(10) Patent No.: US 8,563,099 B2
(45) Date of Patent: Oct. 22, 2013

(54) ARTIFICIAL TURF STRUCTURE AND PRODUCTION METHOD THEREFORE

(75) Inventor: Maurizio Gilardi, Villa d'Adda (IT)

(73) Assignee: Italgreen S.p.A., Villa d'Adda (IT)

( * ) Notice: Subject to any disclaimer, the term of this patent is extended or adjusted under 35 U.S.C. 154(b) by 719 days.

(21) Appl. No.: 11/996,273

(22) PCT Filed: Oct. 21, 2005

(86) PCT No.: PCT/IB2005/003145

§ 371 (c)(1),
(2), (4) Date: Jul. 25, 2008

(87) PCT Pub. No.: WO2007/010324

PCT Pub. Date: Jan. 25, 2007

(65) Prior Publication Data

US 2008/0299331 A1 Dec. 4, 2008

(30) Foreign Application Priority Data

Jul. 21, 2005 (IT) ..... MI2005A1403

(51) Int. Cl.
*E01C 13/08* (2006.01)
*B32B 33/00* (2006.01)

(52) U.S. Cl.
USPC ..... 428/22; 428/17; 428/87

(58) Field of Classification Search
USPC ..... 428/87, 402, 17, 22; 427/202
See application file for complete search history.

(56) References Cited

U.S. PATENT DOCUMENTS

| | | | | |
|---|---|---|---|---|
| 4,337,283 | A | 6/1982 | Haas, Jr. | |
| 4,735,825 | A | 4/1988 | Friedrich et al. | |
| 4,900,010 | A * | 2/1990 | Wengmann et al. | 472/92 |
| 5,958,527 | A * | 9/1999 | Prevost | 428/17 |
| 6,029,397 | A * | 2/2000 | Motz et al. | 47/58.1 R |
| 6,173,528 | B1 * | 1/2001 | Motz et al. | 47/58.1 R |
| 6,189,260 | B1 * | 2/2001 | Kusey et al. | 47/9 |
| 6,242,062 | B1 * | 6/2001 | de Vries | 428/17 |
| 6,295,756 | B1 * | 10/2001 | Bergevin | 47/1.01 R |
| 6,391,120 | B1 | 5/2002 | Silva | |
| 6,408,568 | B1 | 6/2002 | Yelanich et al. | |
| 6,582,819 | B2 * | 6/2003 | McDaniel et al. | 428/402 |
| 6,596,324 | B1 * | 7/2003 | Homan | 424/761 |
| 6,632,527 | B1 * | 10/2003 | McDaniel et al. | 428/402 |

(Continued)

FOREIGN PATENT DOCUMENTS

| | | |
|---|---|---|
| EP | 0174755 A | 3/1986 |
| EP | 0867112 | 9/1998 |

(Continued)

OTHER PUBLICATIONS

Mar. 30, 2010 Office Action for related Appln. No. EP 05794309.4.

(Continued)

*Primary Examiner* — Cheryl Juska
(74) *Attorney, Agent, or Firm* — Volpe and Koenig, P.C.

(57) ABSTRACT

An artificial turf structure, in particular for sports fields, consists of a synthetic mat, having a substrate from which grass-resembling filaments project, and a filling layer formed by an infill material arranged between the filaments; the infill material forming the filling layer comprises a coconut-based vegetable material, in particular coco fiber and/or coco peat or other similar vegetable material in fibrous, ground and/or shredded form.

10 Claims, 1 Drawing Sheet

(56) References Cited

U.S. PATENT DOCUMENTS

| | | | | |
|---|---|---|---|---|
| 8,024,890 | B2 * | 9/2011 | Bertin et al. | 47/9 |
| 8,221,029 | B2 * | 7/2012 | Henry et al. | 405/36 |
| 2001/0007700 | A1 * | 7/2001 | de Vries | 428/17 |
| 2002/0048676 | A1 * | 4/2002 | McDaniel et al. | 428/404 |
| 2003/0039511 | A1 | 2/2003 | Prevost | |
| 2007/0248773 | A1 * | 10/2007 | Nusca et al. | 428/22 |
| 2009/0113791 | A1 * | 5/2009 | Bertin et al. | 47/9 |
| 2010/0055461 | A1 * | 3/2010 | Daluise et al. | 428/403 |
| 2010/0166984 | A1 * | 7/2010 | Nusca | 428/17 |
| 2010/0294705 | A1 * | 11/2010 | Henry et al. | 210/170.07 |
| 2012/0189786 | A1 * | 7/2012 | Nusca | 428/17 |
| 2012/0279125 | A1 * | 11/2012 | Nusca et al. | 47/66.7 |

FOREIGN PATENT DOCUMENTS

| | | | | |
|---|---|---|---|---|
| EP | 2206833 | A1 | * | 7/2010 |
| FR | 2753211 | A | | 3/1998 |
| GB | 2139609 | A | | 11/1984 |
| GB | 2272903 | | | 6/1994 |
| GB | 2308538 | | | 7/1997 |
| IT | PI2003A000036 | | | 8/2003 |
| JP | 2010159620 | A | * | 7/2010 |
| KR | 749075 | B1 | * | 8/2007 |
| KR | 919458 | B1 | * | 9/2009 |
| KR | 919459 | B1 | * | 9/2009 |
| KR | 2010088590 | A | * | 8/2010 |
| KR | 2011030932 | A | * | 3/2011 |
| WO | 2004078892 | A1 | | 9/2004 |
| WO | 2006008579 | A1 | | 1/2006 |
| WO | WO 2006109110 | A1 | * | 10/2006 |
| WO | WO 2008053389 | A1 | * | 5/2008 |
| WO | WO 2008115085 | A1 | * | 9/2008 |
| WO | WO 2008125895 | A1 | * | 10/2008 |
| ZA | 200906857 | A | * | 5/2010 |

OTHER PUBLICATIONS

Apr. 14, 2011 Communication issued in counterpart EP Appln. No. 05794309.4.

EP Communication May 31, 2012, Application No. 05 749 309.4.

International Search Report, Application No. PCT/GB2004/000962, dated Jun. 21, 2004.

* cited by examiner

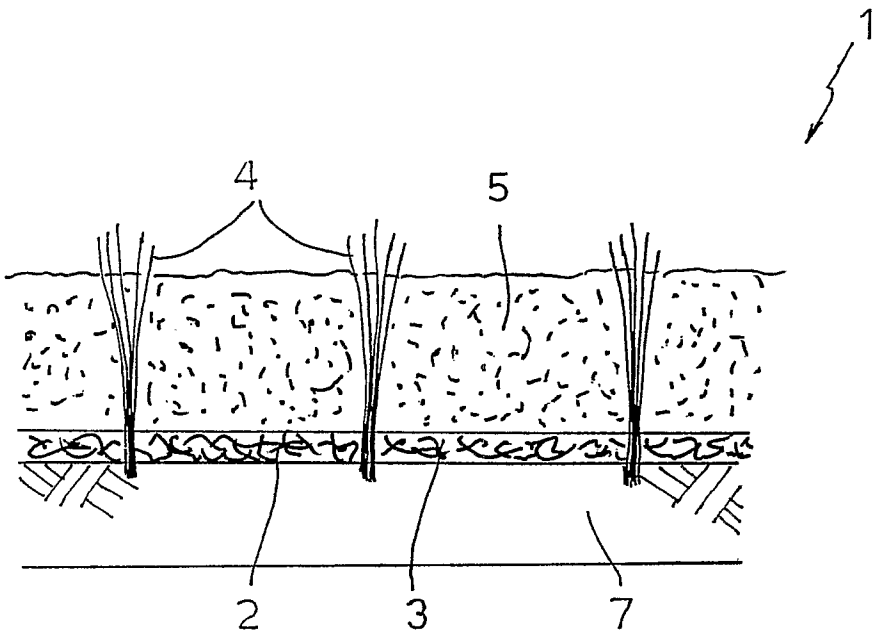
1
4
5
2
3
7

ARTIFICIAL TURF STRUCTURE AND PRODUCTION METHOD THEREFORE

FIELD OF INVENTION

The present invention relates to an artificial turf structure, in particular for sports fields, a method for manufacturing the same.

BACKGROUND

It is known that, in general terms, artificial turfs, in particular for sports fields, consist of a synthetic mat formed by a sheet substrate in which there extend vertically filaments which simulate a natural greensward; infill materials are arranged between the filaments to form one or more filling layers; the infill materials most commonly used are sand and relatively elastic polymeric materials (mainly natural or synthetic rubber, but also thermoplastic materials of various types), which are either mixed together or arranged in layers, according to various methods.

U.S. Pat. No. 4,735,825 and EP-A-174755 disclose artificial turf structure including as an infill material cork granules and peat-based materials respectively.

WO2006/08579 discloses a mixed turf (i.e. a turf including both synthetic and natural grass filaments) wherein a layer of organic material, suitable for the development of living plants, is used in combination with a traditional infill material layer.

The known infill materials are not all entirely satisfactory under various aspects, for example in terms of performance, costs, draining capacity and humidity maintenance.

SUMMARY

It is an object of the present invention to provide an artificial turf structure, in particular for sports fields, and a method for manufacturing artificial turfs which are free from the above described drawbacks.

In particular, it is an object of the invention to provide an easily procurable, low cost infill material which is capable of conferring to the artificial turf suitable features of elasticity and compactness, and that allows a good drainage ensuring at the same time a suitable degree of humidity.

The present invention therefore relates to an artificial turf structure, in particular for sports fields, and to the method of manufacturing such an artificial turf structure.

In general terms, the invention therefore concerns the use of a coconut-based vegetable material in fibrous, ground and/or shredded form, as infill material in an artificial turf structure.

The infill material according to the invention is easy and cost-effect to procure and has the suitable features for creating artificial turfs of excellent quality, conferring to the artificial turfs compactness, softness and elasticity; the turfs made according to the invention do not tend to compact and loose the original features of elasticity and softness and are therefore long-lasting with or without little maintenance; they are also poorly abrasive and have a high draining capacity while maintaining a suitable degree of humidity.

BRIEF DESCRIPTION OF THE DRAWING

Further features and advantages of the present invention will be apparent in the description of the following non-limitative examples, with reference to the attached drawing which schematically shows an artificial turf structure according to the invention.

DETAILED DESCRIPTION OF THE PREFERRED EMBODIMENTS

With reference to the attached FIGURE, an artificial turf structure 1 for sports fields comprises a synthetic mat 2, having a sheet substrate 3 from which grass-resembling filaments 4 project, and a filling layer 5 formed by an infill material arranged between the filaments 4. The mat 2 is placed on a foundation base 7, for example a tamped earth bed.

The substrate 3 consists of a sheet or tape of suitable plastic materials, in particular a fabric, a non-woven fabric or a felt made of synthetic rubber, for example styrene-butadiene rubber (SBR), or of synthetic fibres, for example polypropylene or similar, possibly spread or coated with suitable polymeric reinforcement layers. The filaments 4, made of suitable yarns, for example polyethylene, polyamide, polypropylene, etcetera, are sewn or woven on the substrate 3.

The filling layer 5 comprises a coconut-base vegetable material, in fibrous, ground, chopped and/or shredded form.

Hereinafter, "vegetable material" means an essentially not decomposed vegetable material, obtained from vegetable organisms of recent formation and not yet subject to degenerative processes, such as decomposition, rotting, degradation, fossilisation, carbonisation, etcetera.

In particular, the infill material comprises parts of the coconut plant (for example the bark) and/or the nut (shell, hull, pulp, etcetera of the coconut); preferably, the infill material comprises coco fibres and/or coco peat, materials obtained as known from the coconut shells; coco fibre and coco peat can be used mixed together.

In addition to coconut, there may be used other similar vegetable materials, such as for example: vegetable materials derived from the bark of bushes and plants and/or natural fibres obtained from vegetables, in particular agave fibres (particularly sisal) and hemp fibre.

The infill material may be constituted of only vegetable material (that is by one or more of the materials previously indicated); preferably, the infill material contains vegetable material in quantity from about 10% to about 90% by volume.

Preferably, the filling layer 5 also comprises a rigid particulate material, in particular sand in granules commonly used as filling material for artificial turfs. The vegetable material and the rigid particulate material (sand) may be mixed together to form the filling layer 5, or may be arranged in layers (each layer being formed of only one of the materials or their mixture) to form the filling layer 5.

The filling layer 5 also comprises, optionally, one or more of the following components, in any appropriate amount to obtain specific features of the filling layer 5:

peat and/or similar natural organic materials, derived from decomposed or partially decomposed vegetable residues, i.e. natural organic materials with fibrous/filamentous structure of prevalently vegetable origin and essentially derived from decomposition, carbonisation or other type of transformation of vegetable residues (such as indeed peat, vegetable topsoil, vegetable based composting materials);

resilient particulate materials such as rubber, of any type usually employed for artificial turf infill (for example natural or synthetic rubber, thermoplastic elastomers, etcetera);

porous materials in granular form of volcanic origin, such as volcanic lapillus, pumice stone, etcetera, preferably with grain size from about 0.2 to about 2.0 mm.

All components may be mixed together or arranged in layers (each layer being formed by only one of the materials or by a mixture thereof) to form the filling layer 5.

The filling layer 5 may indeed comprise a plurality of layers, each having different structure and/or thickness.

The structure 1 according to the invention is realized using the following method.

After having prepared the foundation base 7 in the known way, it is placed on the foundation base 7 the synthetic mat 2 formed by the substrate 3 and by the filaments 4.

The infill material is prepared as previously described and is sprinkled on the substrate 3 between the filaments 4 to form the filling layer 5.

If the structure 1 comprises several layers with different composition, as previously described, the layers are applied in sequence one on top of the other (after possibly preparing the mixtures of materials forming the various layers).

Finally, it is understood that changes and variations can be made to that described and shown herein without departing from the scope of the attached claims.

For example, according to a further embodiment of the invention, the infill material, possibly formed by a mixture of components previously shown, is used in the form of compact granules. In particular, the various components of the filling layer 5 are subject, before being sprinkled on the substrate 3, to a mixing, densification and granulation process, in which the various components, initially in ground or shredded form, are mixed, densified with possible elimination of part of the humidity, and then compacted in the form of granules having dimensions in the order of a few millimetres.

In this way, it is greatly simplified the installation step of the filling layer 5, because the infill material (regardless of its composition) is applied to the substrate 3 in granular form, thus avoiding the formation and sprinkling of powders; the granules of infill material are then dampened with water so as to dissolve the granules and release the components in the original form.

It is also possible to comprise in the granules all the components needed for the formation of infill material, without therefore requiring the use, during installation, of different materials; it is also possible to comprise in the granules possible further additives, for example colorants to confer to the granules a particular colour, substances adapted to make the granules fireproof, substances adapted to prevent the formation of moulds, fungi, bacteria, etcetera.

The invention claimed is:

1. An artificial turf structure for sports fields, consisting of a synthetic mat having a substrate from which synthetic grass filaments project, and a single filling layer consisting of an infill vegetable material arranged between the filaments; wherein the infill vegetable material consists of vegetable material having a coconut-based vegetable material in both a fibrous form and a ground, chopped, or shredded form; and optionally one or more vegetable materials selected from the group consisting of: vegetable materials derived from the bark of bushes or plants, natural fibres made from vegetables, hemp fibre and peat.

2. A structure according to claim 1, wherein the coconut-based vegetable material and one or more vegetable materials have parts of at least one of: a coconut plant or of a nut.

3. A structure according to claim 1 wherein the coconut-based vegetable material has both coco fibre and coco peat.

4. An artificial turf structure for sports fields, consisting of a synthetic mat having a substrate from which synthetic grass filaments project, and an infill material arranged between the filaments, the infill material consisting of a coconut-based vegetable material in both a fibrous form and a ground, chopped, or shredded form, and at least one component selected from the group consisting of:

vegetable materials derived from the bark of bushes or plants;

natural fibers made from vegetables;

hemp fibre; and peat.

5. A method for manufacturing an artificial turf structure for sports fields, consisting of the steps of:

providing a synthetic mat having a substrate from which synthetic grass filaments project;

preparing a foundation base and laying the synthetic mat on the foundation base;

forming a single filling layer from an infill material that consists of a coconut-based vegetable material in both a fibrous form and a ground, chopped, or shredded form and optionally one or more vegetable materials selected from the group consisting of: vegetable materials derived from the bark of bushes or plants, natural fibres made from vegetables, hemp fibre and peat by disposing the infill material on top of the substrate and between the filaments.

6. A method according to claim 5, wherein the coconut-based vegetable material or one or more vegetable materials have parts of at least one of: a coconut plant or nut.

7. A method according to claim 5 wherein the coconut-based vegetable material has both coco fibre and coco peat.

8. A method according to claim 5, wherein the step of forming a single filling layer includes subjecting the infill material before being disposed, to a process of mixing, densification and granulation.

9. A method according to claim 8, wherein the infill material is disposed on the substrate in granular form and is then wetted with water to dissolve the granules and release the components in the original form.

10. An artificial turf structure for sports fields, consisting of a synthetic mat having a substrate from which synthetic grass filaments project, and a single filling layer consisting of an infill material arranged between the filaments, wherein the infill material consists of coconut-based vegetable material in both a fibrous form and a ground, chopped or shredded form.

* * * * *